United States Patent [19]

Koshizuka et al.

[11] Patent Number: 4,996,093

[45] Date of Patent: Feb. 26, 1991

[54] THERMAL TRANSFER RECORDING MEDIUM

[75] Inventors: Kunihiro Koshizuka; Takao Abe; Tatsuichi Maehashi; Yoshihiro Inaba, all of Hino, Japan

[73] Assignee: Konishiroku Photo Industry Co., Ltd., Tokyo, Japan

[21] Appl. No.: 449,246

[22] Filed: Dec. 7, 1989

Related U.S. Application Data

[63] Continuation of Ser. No. 49,042, May 8, 1987, abandoned, which is a continuation of Ser. No. 792,260, Oct. 28, 1985, abandoned.

[30] Foreign Application Priority Data

Nov. 6, 1984 [JP] Japan ..... 59-232424
Nov. 6, 1984 [JP] Japan ..... 59-232425

[51] Int. Cl.[5] ..... B41M 5/26

[52] U.S. Cl. ..... 428/212; 428/195; 428/336; 428/423.1; 428/474.4; 428/480; 428/484; 428/488.4; 428/913; 428/914

[58] Field of Search ..... 428/195, 207, 211, 212, 428/336, 423.1, 474.4, 480, 484, 488.1, 488.4, 913, 914

[56] References Cited

U.S. PATENT DOCUMENTS 4,617,224 10/1986 Hotta et al. ..... 428/484

FOREIGN PATENT DOCUMENTS 55-105579 8/1980 Japan ..... 428/488.4
57-160691 10/1982 Japan ..... 428/488.1
57-185192 11/1982 Japan ..... 428/488.1

*Primary Examiner*—Bruce H. Hess
*Attorney, Agent, or Firm*—Frishauf, Holtz, Goodman & Woodward

[57] ABSTRACT

There is disclosed a thermal transfer recording medium comprising a support, two or more coloring agent layer and optionally an intermediate layer, wherein one of the coloring agent layers contains a first heat-fusible substance selected from the group consisting of animal waxes, plant waxes, mineral waxes, petroleum waxes, synthetic hydrocarbon waxes and modified waxes and a layer adjacent to the coloring agent layer containing the first heat-fusible substance which contains a second heat-fusible substance which is immiscible with the first heat-fusible substance.

According to the thermal transfer recording medium of the present invention, transferred images with constant transfer density can be obtained with an application energy at a certain level or higher and constant printed letter quality can be obtained for multiple times without being influenced by the subtle change in the application energy.

16 Claims, 2 Drawing Sheets

THERMAL TRANSFER RECORDING MEDIUM

This application is a continuation of application Ser. No. 07/049,042, filed May 8, 1987, (abandoned), which is a continuation of Ser. No. 06/792,260 filed Oct. 28, 1985 (abandoned).

BACKGROUND OF THE INVENTION

This invention relates to a thermal transfer recording medium which can be used for multiple times. More particularly, the present invention pertains to a thermal transfer recording medium by which transferred images with constant transfer density can be obtained with an application energy at a certain level or higher and constant printed letter quality can be obtained for multiple times without being influenced by the subtle change in the application energy.

As the thermal transfer recording medium to be used for multiple times, for example, Japanese Provisional Patent Publication No. 105579/1980 discloses a technique in which a microporous layer is formed with a resin and the layer is impregnated with ink. Also, Japanese Provisional Patent Publication No. 160691/1982 discloses a technique, in which a reticulate structure is formed with the use of organic or inorganic fine powder and impregnated with ink. Further, Japanese Provisional Patent Publication No. 185192/1982 discloses a technique in which a porous paper is impregnated with ink.

All of these techniques are elaborated to permit ink to be oozed out little by little through a porous material, but these involve the problem that the transfer density is changed corresponding to subtle change in application energy, whereby no constant printing letter quality can be obtained.

SUMMARY OF THE INVENTION

The technical task of the present invention is to provide a thermal transfer recording medium by which transferred images with constant transfer density can be obtained with an application energy at a certain level or higher and constant printed letter quality can be obtained for multiple times without being influenced by the subtle change in the application energy.

The present inventors have found, as the result of extensive studies, that the above task can be accomplished by a thermal transfer recording medium, comprising a support, two or more coloring agent layer and optionally an intermediate layer, wherein one of said coloring agent layers contains a first heat-fusible substance selected from the group consisting of animal waxes, plant waxes, mineral waxes, petroleum waxes, synthetic hydrocarbon waxes and modified waxes and a layer adjacent to said coloring agent layer containing said first heat-fusible substance which contains a second heat-fusible substance which is immiscible with said first heat-fusible substance.

DESCRIPTION OF THE PREFERRED EMBODIMENTS

Among the multi-layer thermal transfer recording media, those belong to the technical scope of the present invention, provided that they have two coloring agent layers adjacent to each other indirectly through an intermediate layer between them, at least one of said coloring agent layers contain a first heat-fusible substance selected from the above group of compounds and the other coloring agent layer or said intermediate layer contains a second heat-fusible substance immiscible with said selected heat-fusible substance. Also in the case of having 3 or more coloring agent layers, it may be sufficient that the above conditions of the present invention are satisfied between at least two coloring agent layers or at least one coloring agent layer and said intermediate layer adjacent thereto; but it is desirable that the above conditions of the present invention are satisfied with regard to each of all the coloring agent layers or said intermediate layer adjacent thereto.

The thermal transfer recording medium of the present invention has two or more heat-fusible coloring agent layers provided on a support, which heat-fusible coloring agent layers are formed in multi-layers of two or more layers on a support preferably through an adhesive layer, and an intermediate layer may be provided between the two or more layers. The heat-fusible coloring agent layer is mentioned in the present invention refers to a layer which can be melted by application of energy such as by a thermal head, etc. to be transferred onto the side of a transfer paper to obtain a printed letter with necessary transfer density per one transfer. The intermediate layer which may be optionally provided refers to a layer which can distinguish one coloring agent layer from another by existing interposed between the above heat-fusible coloring agent layers, but cannot itself give a printed letter with necessary transfer density per one transfer.

Figure 1:
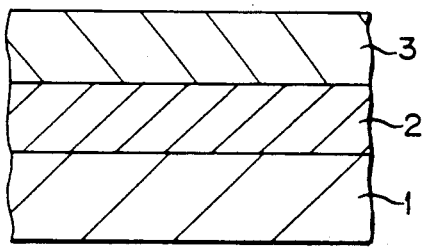
FIG. 1 through FIG. 7 are schematic sectional views of the embodiments of the present invention, respectively.
Figure 2:
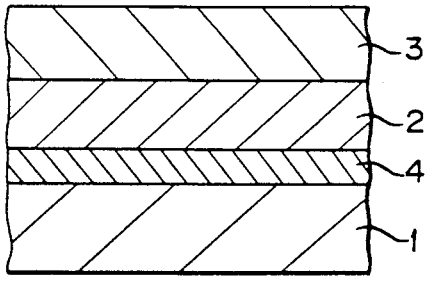
Figure 3:
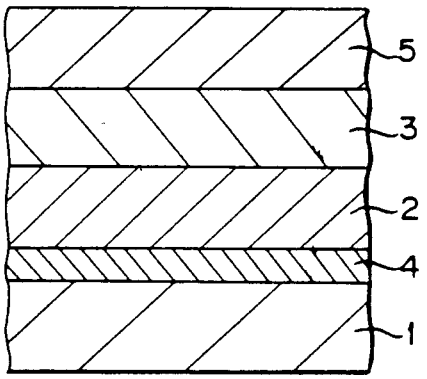

To show a preferable layer constitution in the present invention, there may be mentioned, for example, a multi-layer constitution as shown in FIGS. 1 to 3, in which a coloring agent layer I (reference numeral 2) and a coloring agent layer II (reference numeral 3) are successively provided by coating on a support (reference numeral 1), said coloring agent layer I containing at least one of first heat-fusible substances of the so-called low polarity selected from the above group of compounds and said coloring agent layer II containing a second heat-fusible substance (of the so-called high polarity) immiscible with said first heat-fusible substance. By making such a constitution, a part or all of the composition of the coloring agent layer II comes to have immiscibility with the wax in the coloring agent layer I. In the above multi-layer constitution, an adhesive layer (reference numeral 4) and/or a coloring agent layer III (reference numeral 5) may further be provided as shown in FIGS. 2 and 3.

Figure 4:
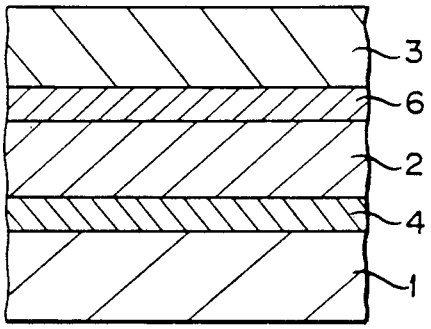

To show another preferable layer constitution in the present invention, there may be mentioned, for example, a multi-layer constitution, in which as shown in FIG. 4 an adhesive layer (reference numeral 4), a coloring agent layer I (reference numeral 2), an intermediate layer I (reference numeral 6) and a coloring agent layer II (reference numeral 3) are successively provided by coating on a support (reference numeral 1), said coloring agent layer I and/or coloring agent layer II containing at least one of first heat-fusible substances of the so-called low polarity selected from the above group of compounds, said intermediate layer I containing a second heat-fusible substance (of the so called high polarity) immiscible with said first heat-fusible substance. By making such a constitution, a part or all of the composition of the intermediate layer I comes to have immiscibility with the wax in the coloring agent layer I and/or the coloring agent layer II.

The present invention utilizes reduction in breaking strength based on the immiscibility (peeling property between the coloring agent layer I and the coloring agent layer II and between the coloring agent layer I and/or the coloring agent layer II and the intermediate layer). More specifically, in the process of applying energy, melting the coloring agent layer and transferring (peeling) to the side of transfer paper, peeling is effected at either (1) near the interface between the coloring agent layer II and the intermediate layer I, (2) near the interface between the coloring agent layer I and the intermediate layer I or (3) the inner portion of the intermediate I, whereby one layer of the coloring agent layer is transferred per one transfer.

Figure 5:
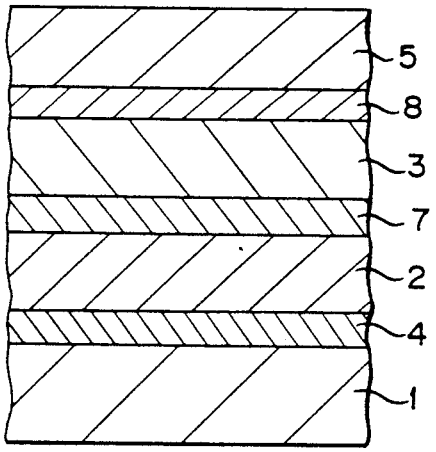

In the case of the above layer constitution, transfer twice is possible, but various layers can be laminated in order to increase the number of transfer, such as by laminating the intermediate layer II (reference numeral 8), the coloring agent layer III (reference numeral 5), the intermediate layer III (not shown), the coloring agent layer IV (not shown), respectively, on the coloring agent layer II (reference numeral 3). The accompanying drawing FIG. 5 illustrates the case when up to the coloring agent layer III is laminated.

In the above case, the coloring agent layers I–IV may have the same composition, respectively, but it is rather preferable that the melting point, viscosity, colorant concentration and film strength should be varied.

Figure 6:
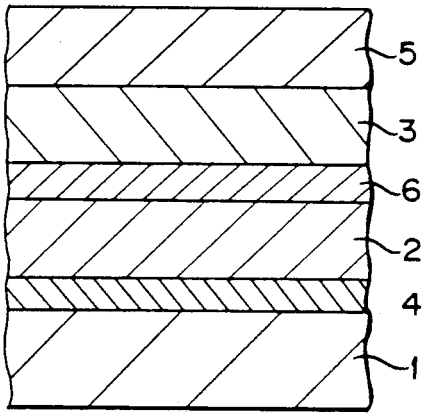
Figure 7:
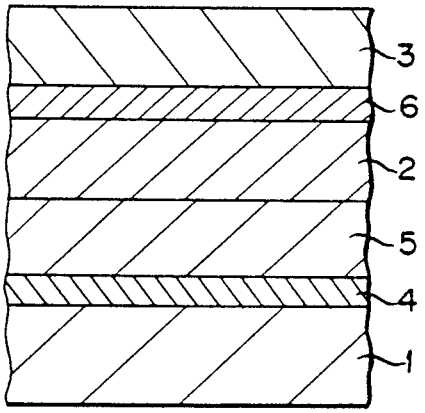

Another embodiment of the present invention has the following layer constitution. That is, as shown in FIG. 6 or FIG. 7, it has the coloring agent layer I (reference numeral 2), the intermediate layer I (reference numeral 6) and the coloring agent layer II (reference numeral 3) as described above, and also having (1) a coloring agent layer III (reference numeral 5) directly on said coloring agent layer II (reference numeral 3) (see FIG. 2) or having (2) a coloring agent layer III (reference numeral 5) directly beneath said coloring agent layer I (reference numeral 2) (see FIG. 3). In the above case (1), for the relationship between the coloring agent layer II and the coloring agent layer III, while in the case of (2), for the relationship between the coloring agent layer I and the coloring agent layer III, either one of the coloring agent layers contains at least one of aforesaid first heat-fusible substance, and the other coloring agent layer is constituted so as to contain a second heat-fusible substance immiscible with the above first heat-fusible substance. The same is the case when a coloring agent layer directly adjacent to these layers is further provided. Details about this point are described in Patent Application (A) filed by the present Applicant on even date herewith.

The intermediate layers such as the above intermediate layer I, II and III, etc. may also contain colorants.

In the present invention, the layer containing at least one first heat-fusible substance should preferably contain no heat-fusible substance immiscible therewith, and the content of such a substance, if any, should preferably be 10% by weight or less based on the total weight of the coloring agent layer.

As the first heat-fusible substance to be used in the present invention, there may be included waxes which are solid at normal temperature, preferably waxes having melting points (measured by the method according to JIS K 2523) or softening points (measured by the Ball and Ring method according to JIS K 2207) of 40° to 90° C., specifically the waxes as mentioned below.

The animal type waxes may include beeswax, insect wax, shellac wax, whale wax, wool wax, etc.; the vegetable type waxes may include carnauba wax, wood wax, auricuri wax, espalt wax, candelilla wax, etc.; mineral type waxes include montan wax, ozocerite wax, ceresin, etc.; petroleum type waxes may include paraffin wax, microcrystalline wax, ester wax, petrolatum, etc.; synthetic hydrocarbon type waxes may include Fischer-Tropsch wax, polyethylene wax, low molecular weight polypropylene, low molecular weight polyethylene and derivatives thereof; and the modified waxes may include oxidized waxes, montan wax derivatives, paraffin or microwax derivatives. These may be used either singly or as a combination of two or more kinds. In the present invention, hydrogenated wax, for example, castor wax, opal wax, etc. may also be available.

In the present invention, as the second heat-fusible substance which is immiscible with the above group of compounds, it is preferred to use a heat-fusible substance which is high in polarity and immiscible with the wax with relatively lower polarity as mentioned above.

In the present invention, immiscibility means that turbidity, oil droplet, phase separation or incompatible state is exhibited when both are mixed by thermal fusion or softening, and it can be detected in appearance in some cases, although it is not necessarily required to be detected.

As one method for representing polarity, solubility parameter $\delta$ may be employed, and the solubility parameter of the heat-fusible substance with higher polarity may be $\delta \leqq 9.5$, more preferably $\delta \leqq 10.0$. On the other hand, the solubility parameter of the waxes with relatively lower polarity as represented by the above group of compounds may be represented as $\delta > 9.0$.

As the second heat-fusible substance immiscible with the above first heat-fusible substance, rather than a substance of which the main chain is constituted simply of carbon-carbon bonds as a vinyl polymer, but a synthetic polymeric compound containing bonding so as to impart polarity in the main chain is preferred.

Typical compounds may include polyester type compounds, polyether type compounds, polyamide type compounds, polyurethane type compounds, etc.

Among them, those which are solid at normal temperature (25° C.), for example, substances having relatively lower melting points (measured by the method according to JIS K 2523) or softening points (measured by the Ball and Ring method according to JIS K 2207), preferably of 35° to 100° C., more preferably 45° to 85° C., may be used. Also, in view of breaking strength, the molecular weight should preferably be lower, specifically 500 or more and 50,000 or less, more preferably 1000 or more and 15,000 or less.

Specific examples may include the compounds as set forth below.

(1) Polyester type compounds:

Preferable polyester compounds are straight polyesters and derivatives thereof having —CO—O— bonding in the main chain which are solid at normal temperature (25° C.), including polycarbonates, unsaturated polyesters having —CO—O— bonding in the main chain.

These polyesters can be synthesized as polycondensation products between polyhydric alcohols and polybasic acids or ring-opening polymerized products of lactams.

In the case when the polyester derivative is a copolymer, it should preferably be a block copolymer or a graft copolymer, and it is also preferred that the ester bonding portions should be contained as much as possible.

Specific examples may include polyethylene glycol fatty acid esters, polyethylene glycol sorbitane fatty acid esters, polyoxyethylene lanolin fatty acid ester, block copolymers synthesized from polyethylene glycol and ε-caprolactone, etc.

The polyester type compounds formed by polymerization according to the following reaction from compounds having alcoholic OH groups and e-caprolactone are available as commercial products.

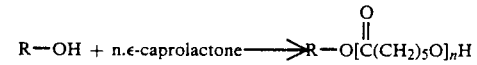

Names of commercial product: "Placcel G-402", "Placcel 240", "Placcel 260", "Placcel 280", "Placcel H-1" (all are produced by Dicel Kagaku Co.).

(2) Polyether type compounds:

Preferable polytether type compounds are compounds having —C—O—C— bonding in the main chain which are solid at normal temperature (25° C.), also including polyethylene oxide and epoxy resins having —O— bonding in the main chain.

The above polyether type compounds can be synthesized by ring-opening polymerization of cyclic ethers, ring-opening polymerization of cyclic acetals, high polymerization of aldehydes, polycondensation of glycols, etc.

Typical compounds of said polyether type compounds may include polyethylene glycols and polyethylene glycol derivatives, specifically polyethylene glycol; ether type compounds such as polyethylene glycol alkyl ether, polyethylene glycol polypropylene glycol ether, polyethylene glycol alkyl phenol ether, polyethylene glycol nonyl phenyl ether, polyoxyethylene lanolin alcohol ether, etc.

Among them, polyethylene glycols with molecular weights of 1000 to 10000 may preferably be employed in the present invention.

(3) Polyamide type compounds:

Preferable polyamide type compounds are synthetic polymeric compounds having —CO—NH— bonding in the main chain. Said compounds may be synthesized by polycondensation of dicarboxylic acids and diamines or ω-aminocarboxylic acids or ring-opening polymerization of lactams thereof.

Said compounds may be either saturated or unsaturated, and also may be aromatic compounds. Said compounds are also commercially available and, for example, Sanmide series produced by Sanwa Kagaku Co. can be used.

(4) Polyurethane type compounds:

Polyurethane type compounds are compounds containing —NHCO— in the main chain, and may typically be synthesized by polyaddition reaction between diisocyanate esters and glycols.

Said polyurethane type compounds are also commercially available. For example, Urethane Wax HSW-E1 produced by Hodogaya Kagaku Co. can be used.

The content of the second heat-fusible substance immiscible with the above group of compounds may preferably be 8 to 95%, more preferably 15 to 90%, based on the total amount of the coloring agent layer containing said substance and those may preferably be 8 to 100%, more preferably 20 to 100%, based on the total amount of the intermediate layer containing said substance.

As the heat-fusible substance immiscible with the above group of compounds, it is possible to incorporate the resin components as disclosed in Japanese Provisional Patent Publication No. 68253/1979, for example, polyvinyl chloride, polyvinyl acetate, vinyl chloride-vinyl acetate copolymer, polystyrene, etc., but use of such a resin component in too much an amount is rather undesirable.

The heat-fusible substance immiscible with the above group of compounds may be used either singly or as a mixture of two or more kinds.

In the present invention, a colorant is contained in the heat-fusible coloring agent layer, but it can also be contained in the intermediate layer. When contained in the intermediate layer, it can contribute to improvement of the transfer density of the coloring agent layer in contact with the intermediate layer.

The colorant to be used in the present invention may be selected appropriately from among dyes, including dyes such as direct dyes, acidic dyes, basic dyes, disperse dyes, oil-soluble dyes (including metal-containing oil-soluble dyes), and various pigments. Specifically, the following dyes may be included. That is, as the yellow dyes, there may preferably be employed Kayaron Polyester Light Yellow 5G-S (Nippon Kayaku), Oil Yellow S-7 (Hakudo), Eisenspiron Yellow GRS Special (Hodogaya), Sumiplast Yellow FG (Sumitomo), Eisenspiron Yellow GRH (Hodogaya), etc. As the red dyes, there may preferably be employed Diaseritone Fast Red R (Mitsubishi Kasei), Dianix Brilliant Red BS-E (Mitsubishi Kasei), Sumiplast Red FB (Sumitomo), Sumiplast Red HFG (Sumitomo), Kayaron Polyester Pink RCL-E (Nippon Kayaku), Eisenspiron Red GEH Special (Hodogaya, etc.). As the blue dyes, there may preferably be employed Diaseritone Fast Brilliant Blue R (Mitsubishi Kasei), Dianix Blue EB-E (Mitsubishi Kasei), Kayaron Polyester Blue B-SF conc. (Nippon Kayaku), Sumiplast Blue 3R (Sumitomo), Sumiplast Blue G (Sumitomo), etc. As the yellow pigments, Hanza Yellow 3G, Taltrazin Lake, etc. may be employed; as the red pigments, Brilliant Carmine FB Pure (Sanyo Shikiso), Brilliant Carmine 6B (Sanyo Shikiso), Alizarine Lake, etc.; as the blue pigments, Cerlean Blue, Sumicaprint Cyanine Blue GN-0 (Sumitomo), Phthalocyanine Blue, etc.; and as black pigments, carbon black, oil black, etc. Among the colorants to be used in the present invention, the most preferred is carbon black.

An object of the present invention is to make the transfer density substantially the same, provided that the application energy is at a certain level or higher, and within the scope which can accomplish this object, another coloring agent layer may contain a colorant which is different in kind from that contained in one coloring agent layer.

In the present invention, a softening agent may be used, and low-softening polymers selected from ethylene-ethyl acrylate copolymers, ethylene-vinyl acetate copolymers may be included as such softening agent.

The compositional ratio of the coloring agent layer in the present invention is not limited but it may preferably be as follows:

Constitution (A)

Coloring agent layer I: per 100 parts (weight parts, hereinafter the same) of the total solids in said colorant layer I, 30 to 95 parts (more preferably 40 to 90 parts) of a first heat-fusible substance, 5 to 40 parts (more preferably 10 to 35 parts) of a colorant, 0 to 20 parts (more preferably 1 to 15 parts) of a softening agent;

Coloring agent layer II: per 100 parts of the total solids in said intermediate layer I, 8 to 95 parts (more preferably 15 to 90 parts) of a second heat-fusible substance immiscible with said heat-fusible substance, 0 to 70 parts (more preferably 10 to 60 parts) of a heat-fusible substance other than said immiscible second heat-fusible substance, 5 to 40 parts (more preferably 10 to 35 parts) of a colorant and 0 to 15 parts (more preferably 1 to 10 parts of) of a softening agent;

Coloring agent layer III: per 100 parts of the total solids in said coloring agent layer III, 30 to 95 parts (more preferably 40 to 90 parts) of a heat-fusible substance, 5 to 40 parts (more preferably 10 to 35 parts) of a colorant and 0 to 20 parts (more preferably 1 to 15 parts) of a softening agent.

Constitution (B)

Coloring agent layer I: per 100 parts (weight parts, hereinafter the same) of the total solids in said colorant layer I, 30 to 95 parts (more preferably 40 to 90 parts) of a heat-fusible substance, 5 to 40 parts (more preferably 10 to 35 parts) of a colorant, 0 to 20 parts (more preferably 1 to 15 parts) of a softening agent;

Intermediate layer I: per 100 parts of the total solids in said intermediate layer I, 8 to 100 parts (more preferably 20 to 100 parts) of a heat-fusible substance immiscible with said heat-fusible substance, 0 to 70 parts (more preferably 10 to 60 parts) of a heat-fusible substance other than said immiscible heat-fusible substance, 0 to 40 parts (more preferably 0 to 35 parts) of a colorant and 0 to 20 parts (more preferably 5 to 15 parts of) of a softening agent;

Coloring agent layer II: per 100 parts of the total solids in said coloring agent layer II, 30 to 95 parts (more preferably 40 to 90 parts) of a heat-fusible substance, 5 to 40 parts (more preferably 10 to 35 parts) of a colorant and 0 to 20 parts (more preferably 1 to 15 parts) of a softening agent.

As mentioned above, an object of the present invention is to make the transfer density substantially the same, provided that the application energy is at a certain level or higher within the scope which can accomplish this object, another coloring agent layer may contain a colorant which is different in kind from that contained in one coloring agent layer.

Also, as in the above example of the intermediate layer I, when other heat-fusible substances than the immiscible heat-fusible substance are to be contained, its content may preferably be 70% or less of the total heat-fusible substances, more preferably 60% or less, particularly 50% or less.

In the heat-fusible coloring agent layer of the present invention, in addition to the above components, various additives may be contained. For example, vegetables such as castor oil, linseed oil, olive oil, animal oils such as whale oil and mineral oils may preferably be employed.

The thermal transfer recording medium of the present invention, for coating of the heat-fusible coloring agent layer and the intermediate layer on a support can be formed by hot melt coating of a heat-fusible colorant composition or an intermediate layer composition or by solvent coating of a coating solution having said composition dissolved or dispersed in an appropriate solvent. As the coating method, there may be employed any desired known technique such as the reverse roll coater method, the extrusion coater method, the gravure coater method, the wire bar coating method, etc. Particularly, in the case of the layer constitution as in the present invention, it is preferable to effect wholly or partially the simultaneous overlaying coating. It is also preferable to apply coating with a plurality of coaters prepared in one line.

It is also possible to prepare a thermal transfer recording medium for multi-use and multi-color by use of heat-fusible colorant compositions with several kinds of different tones. More specifically, the support is divided into portions at certain intervals in the longitudinal direction. In the case of, for example, employing yellow, magenta, cyan and black heat-fusible coloring agent layer compositions, the yellow composition is applied to a desired length in the longitudinal direction on the support and the yellow composition is made to have the multi-layer constitution of the present invention, followed successively by coating of the magenta composition, the cyan composition, and the black composition adjacent to one another, each being at a desired length in the longitudinal direction and so as to have the multi-layer constitution of the present invention, thus forming a multi-layer divided into at least 4 divisions to give one block, which block may be provided by coating repeatedly. It is also preferable to provide a mark for demarcation between the layers divided into different colors. By doing so, multiple printing of the same color is rendered possible simultaneously with multi-color printing.

The thickness of each heat-fusible coloring agent layer of the present invention may preferably be 1 to 10 μm, more preferably 2 to 7 μm. The intermediate layer may have a thickness preferably of 0.05 to 4 μm, more preferably 0.5 to 2 μm.

In the present invention, when a subbing layer or an adhesive layer is provided between the support and the heat-fusible coloring agent layer, said subbing layer or the adhesive layer may be formed of a material selected appropriately from hot melt type adhesives. Specific examples may include ethylene-vinyl acetate copolymer, ethylene-acrylate copolymer, polyethylene, polyamide, polyester, petroleum resin, nylon, etc., and one or a combination of two or more kinds thereof may be used. The thickness of the subbing layer or the adhesive layer may preferably be 0.5 to 2 μm.

The support to be used for the thermal transfer recording medium in the present invention may desirably be a support having heat-sensitive strength and having high dimensional stability and surface smoothness. As the heat-resistant strength, it is required to have strength and dimensional stability which can retain toughness of the support which will not be softened or plastified by the heating temperature of the heat source such as thermal heat, etc. As the surface smoothness, it is desirable to have a smoothness enough for the coloring agent layer containing the heat-fusible substance on the support to exhibit good transfer efficiency. The smoothness may preferably be 100 sec or higher as measured by the Bekk testing machine (JIS P 8119), more preferably 300 sec or higher to give images with better transfer efficiency and reproducibility. As the material, there may be used, for example, papers such as plain paper, condenser paper, laminated paper, coated paper, etc; resins films such as polyethylene, polyethylenterephthalate, polyester, polystyrene, polypropylene, polyimide, etc. and paper-resin film composites; metal sheets such as aluminum foil, etc. The support may have a thickness generally of about 60 μm or more, particularly preferably 2 to 20 μm, for obtaining good thermal conductivity. The thermal transfer recording medium may also have a protective layer, etc., its constitution on the back side may be made as desired, and a backing layer such as sticking preventive layer, etc. may also be provided.

According to the present invention, transferred images with constant transfer density can be obtained with an application energy at a certain level or higher and at the same time constant printed letter quality can be obtained for multiple times without being influenced by the subtle change in application energy.

The present invention is described below by referring to Examples, by which the present invention is not limited at all. The "parts" used in the following description indicate "parts by weight".

EXAMPLE 1

The multi-layer construction as shown below was formed by successively the respective layers on a polyterephthalate support with a thickness of 4.0 μm by means of a wire bar according to the solvent method or the hot melt method to a dried film thickness as a whole of 11 μm to obtain a thermal transfer recording medium Sample (1) of the present invention.

Composition and thickness of respective layers (written in the order nearer to support):

| | |
|---|---|
| I: Adhesive layer: | |
| (1) composition: | |
| Ethylene-ethyl acrylate copolymer (NUC 6070, produced by Nippon Unicar Co.) | 100 parts |
| (2) thickness: 1 μm (dried film thickness, hereinafter the same). | |
| II: Coloring agent layer I: | |
| (1) composition: | |
| Carnauba wax | 25 parts |
| Paraffin wax (m.p. = 62° C.) | 45 parts |
| Carbon black | 15 parts |
| Ethylene-vinyl acetate copolymer | 7 parts |
| Montan wax (m.p. = 63° C.) | 8 parts |
| (2) thickness: 5 μm. | |
| III: Coloring agent layer II: | |
| (1) composition: | |
| Polyester wax (Placcel 260, produced by Dicel Kagaku Co.) | 73 parts |
| Carbon black | 15 parts |
| Carnauba wax | 5 parts |
| Ethylene-vinyl acetate copolymer | 7 parts |
| (2) thickness: 5 μm. | |

The Sample (1) of thermal transfer recording medium was made into a ribbon with a width of 8 mm, and an applying energy of 0.71 mJ/dot was given thereto by use of a thermal printer (a trial machine mounted with a thin film type line thermal head with a heat-generating element density of 8 dot/mm) to effect printing (letter printing) on plain paper. As the plain paper, a commercially available pure paper (100 sec) was employed.

The results are shown in Table 1.

EXAMPLE 2

In Example 1, the same procedures were carried out except that the following coloring agent layers I and II were employed to obtain thermal transfer recording medium Sample (2).

| | |
|---|---|
| (1) Coloring agent layer I | |
| Carnauba wax | 10 parts |
| Polyethylene wax | 15 parts |
| Paraffin wax | 20 parts |
| Microwax | 20 parts |
| Carbon black | 15 parts |
| Ethylene-ethyl acrylate copolymer | 20 parts |
| (2) Coloring agent layer II | |
| Paraffin wax | 20 parts |
| Polyethylene glycol | 30 parts |
| Carbon black | 15 parts |
| Oxidized wax | 10 parts |
| Hoechst F | 25 parts |

By use of this thermal transfer recording medium Sample (2), letter printing was effected by use of a thermal printer similarly as in Example 1. The results are shown in Table 1.

COMPARATIVE EXAMPLE 1

In Example 1, the composition of the coloring agent layer II was not provided and the film thickness of the coloring agent layer I was changed to 10 μm, following otherwise the same procedure to prepare a thermal transfer recording medium Sample (3) for comparative purpose.

By use of this thermal transfer recording medium Sample (3), letter printing was effected by use of a thermal printer similarly as in Example 1. The results are shown in Table 1.

TABLE 1

| | Optical reflective density | | | |
|---|---|---|---|---|
| | First | Second | Third | Remarks |
| Sample (1) | 1.77 | 1.82 | 1.70 | This invention |
| Sample (2) | 1.73 | 1.79 | 1.69 | This invention |
| Sample (3) | 2.10 | 0.0* | 0.0* | Comparative |

Note
In the above Table, "0.0*" represents approximately zero.

As also apparent from the above Table, in the sample of the present invention, the densities were satisfactory in both of the first and second printing. Thus, according to the present invention, it can be appreciated that multiple letter printing with substantially the same transfer density can be effected. In contrast, in the case of the comparative sample, although an image with high density can be obtained in the first printing, no image could be obtained in the second printing and thereafter.

EXAMPLE 3

The multi-layer construction as shown below was formed by applying successively the respective layers on a polyethyleneterephthalate support with a thickness of 4.0 μm by means of a wire bar according to the solvent method or the hot melt method to a dried film thickness as a whole of 15 μm to obtain a thermal transfer recording medium Sample (4) of the present invention.

Composition and thickness of respective layers (written in the order nearer to support):

| | |
|---|---|
| I: Adhesive layer: | |
| (1) composition: | |
| Ethylene-ethyl acetate copolymer (NUC 6070, produced by Nippon Unicar Co.) | 100 parts |
| (2) thickness: 1 μm | |
| II: Coloring agent layer I: | |
| (1) composition: | |
| Carnauba wax | 35 parts |
| Paraffin wax | 45 parts |
| Carbon black | 15 parts |
| Ethylene-vinyl acetate copolymer | 5 parts |
| Beeswax | 8 parts |
| (2) thickness: 4 μm. | |
| III: Intermediate layer: | |
| (1) composition: | |
| Ethylene-vinyl acetate copolymer | 10 parts |
| Paraffin wax (m.p. = 62° C.) | 45 parts |
| Polyethylene glycol (Mw = 6000) | 45 parts |
| (2) thickness: 2 μm. | |
| IV: Coloring agent layer II: | |
| (1) composition: | |
| Carnauba wax | 42 parts |
| Paraffin wax (m.p. = 62° C.) | 30 parts |
| Carbon black | 15 parts |
| Ethylene-vinyl acetate copolymer | 5 parts |
| Beeswax | 8 parts |
| (2) thickness: 4 μm. | |

The Sample (4) of thermal transfer recording medium was made into a ribbon with a width of 8 mm, and an applying energy of 0.71 mJ/dot was given thereto by use of a thermal printer (a trial machine mounted with a thin film type line thermal head with a heat-generating element density of 8 dot/mm) to effect printing (letter printing) on plain paper. As the plain paper, a commercially available pure paper (100 sec) was employed

COMPARATIVE EXAMPLE 2

In Example 3, the composition of the intermediate layer was changed to that as shown below, following otherwise the same procedure to prepare a thermal transfer recording medium sample (5) for comparative purpose.

| (Composition of intermediate layer) | |
|---|---|
| Ethylene-vinyl acetate copolymer | 10 parts |
| Paraffin wax (m.p. = 62° C.) | 90 parts |

By use of this thermal transfer recording medium Sample (5), letter printing was effected by use of a thermal printer similarly as in Example 3.

The results are shown in Table 2.

TABLE 2

| | Optical reflective density | | | |
|---|---|---|---|---|
| | First | Second | Third | Remarks |
| Sample (4) | 1.71 | 1.60 | 1.21 | This invention |
| Sample (5) | >2.3 | 0.0* | 0.0* | Comparative |

Note
In the above Table, "0.0*" represents approximately zero.

As also apparent from the above Table, in the sample of the present invention, the densities were satisfactory in both of the first and second printing Thus, according to the present invention, it can be appreciated that multiple letter printing with substantially the same transfer density can be effected In Example 1, when the minute amount of the residual layer surface after the first letter printing was sampled and analyzed, polyethylene glycol component was detected In contrast, in the case of the comparative sample, although an image with high density can be obtained in the first printing, no image could be obtained in the second printing and thereafter.

What we claim is:

1. A thermal transfer recording medium comprising a support and on said support:
   (a) two coloring agent layers disposed successively on said support; or
   (b) said two coloring agent layers with an intermediate layer positioned between said support and the coloring agent layer closest to said support; or
   (c) said two coloring agent layers with an intermediate layer positioned between said coloring agent layers;
   a first of said coloring agent layers containing a first heat-fusible wax selected from the group consisting of animal wax, plant wax, mineral wax, petroleum wax, and synthetic hydrocarbon wax and an adjacent layer to said first of said coloring agent layers containing a second heat-fusible substance which is immiscible with said first heat-fusible wax, said adjacent layer being (i) a second said coloring agent layer or (ii) said intermediate layer.

2. A thermal transfer recording medium of claim 1, wherein said first heat-fusible substance has the melting point or softening point in the range of 40° C. to 90° C.

3. A thermal transfer recording medium of claim 2, wherein said first heat-fusible substance is selected from the group consisting of insect wax, shellac wax, whale wax, wool wax; carnauba wax, wood wax, auricuri wax, espalt wax, candelilla wax; montan wax, ozocerite wax, ceresin; paraffin wax, microcrystalline wax, ester wax, petrolatum; Fischer-Tropsch wax, polyethylene wax, low molecular weight polypropylene, oxidized waxes, montan wax derivatives, paraffin castor wax and opal wax.

4. A thermal transfer recording medium of claim 1, wherein said first heat-fusible substance has the solubility parameter of less than 9.0 and said second heat-fusible substance has the solubility parameter of more than 9.5.

5. A thermal transfer recording medium of claim 1, wherein said second heat-fusible substance has the melting point or softening point in the range of 35° C. to 100° C.

6. A thermal transfer recording medium of claim 5, wherein said second heat-fusible substance is selected from the group consisting of polyester compounds, polyether compounds, polyamide compounds and polyurethane compounds.

7. A thermal transfer recording medium of claim 6, wherein said second heat-fusible substance has a molecular weight of 500 to 50,000.

8. The thermal transfer medium of claim 1 wherein said adjacent layer is said second coloring agent layer.

9. A thermal transfer recording medium of claim 2, wherein the content of said first heat-fusible substance is in the range of 8% to 95% by weight of total amount of said coloring agent layer containing said first heat-fusible substance.

10. The thermal transfer recording medium of claim 1, wherein said adjacent layer is an intermediate layer which is positioned between said first and second coloring agent layers.

11. A thermal transfer recording medium of claim 10, wherein the content of said second heat-fusible substance is in the range of 8% to 100% by weight of total amount of said intermediate layer.

12. A thermal transfer recording medium of claim 10, wherein said intermediate layer has the thickness of in the range of 0.05 μm to 4 μm.

13. A thermal transfer recording medium of claim 1, wherein each of said coloring agent layers has the thickness of in the range of 1 μm to 10 μm.

14. A thermal transfer recording medium of claim 13, wherein each of said coloring agent layers contains a coloring agent selected from the group consisting of direct dyes, acid dyes, basic dyes, disperse dyes, oil-soluble dyes and pigments.

15. The thermal transfer recording medium of claim 1, wherein said layer adjacent to said coloring agent layer is an intermediate layer which is positioned between said coloring agent layer containing the first heat-fusible substance and said support.

16. A thermal transfer recording medium comprising a support and on said support:

(a) two coloring agent layers disposed successively on said support; or (b) said two coloring agent layers with an intermediate layer positioned between said support and the coloring agent layer closest to said support; or (c) said two coloring agent layers with an intermediate layer positioned between said coloring agent layers;

a first of said coloring agent layers containing a first heat-fusible wax selected from the group consisting of animal wax, plant wax, mineral wax, petroleum wax, and synthetic hydrocarbon wax;

an adjacent layer to said first of said coloring agent layers containing a second heat-fusible substance which is immiscible with said first heat-fusible wax, said adjacent layer being (i) a second said coloring agent layer or (ii) said intermediate layer; and wherein said first coloring agent layer is closer to the support than said second coloring agent layer.

* * * * *